US006999715B2

(12) United States Patent
Hayter et al.

(10) Patent No.: US 6,999,715 B2
(45) Date of Patent: Feb. 14, 2006

(54) BROADCAST AUDIENCE SURVEILLANCE USING INTERCEPTED AUDIO

(76) Inventors: Gary Alan Hayter, 4409 Harbord Dr., Oakland, CA (US) 94618; Paul E. Graf, 983-7 Asilomar Ter., Sunnyvale, CA (US) 94083; Alan Alexander Burns, 108 Ramona Rd., Portola Valley, CA (US) 94028

( * ) Notice: Subject to any disclaimer, the term of this patent is extended or adjusted under 35 U.S.C. 154(b) by 591 days.

(21) Appl. No.: 10/016,380

(22) Filed: Dec. 10, 2001

(65) Prior Publication Data

US 2002/0072325 A1 Jun. 13, 2002

Related U.S. Application Data

(60) Provisional application No. 60/254,740, filed on Dec. 11, 2000.

(51) Int. Cl.
*H04H 9/00* (2006.01)

(52) U.S. Cl. ..... 455/2.01; 455/3.06

(58) Field of Classification Search ..... 455/2.01, 455/423, 405, 426.1, 414.1, 3.06
See application file for complete search history.

(56) References Cited

U.S. PATENT DOCUMENTS

| | | | | |
|---|---|---|---|---|
| 4,955,070 | A | 9/1990 | Welsh et al. | |
| 5,410,724 | A | 4/1995 | Worthy | |
| 5,436,653 | A | 7/1995 | Ellis et al. | |
| 5,574,962 | A | 11/1996 | Fardeau et al. | |
| 5,594,934 | A | 1/1997 | Lu et al. | |
| 5,612,729 | A | 3/1997 | Ellis et al. | |
| 5,621,454 | A | 4/1997 | Ellis et al. | |
| 5,749,043 | A | 5/1998 | Worthy | |
| 5,787,334 | A | 7/1998 | Fardeau et al. | |
| 5,839,050 | A * | 11/1998 | Baehr et al. | 455/2.01 |
| 6,035,177 | A | 3/2000 | Moses et al. | |
| 6,112,053 | A | 8/2000 | Dunki-Jacobs et al. | |
| 6,151,578 | A | 11/2000 | Bourcet et al. | |
| 6,389,055 | B1 * | 5/2002 | August et al. | 375/130 |
| 2004/0048637 | A1 * | 3/2004 | Atkinson | 455/569.1 |
| 2004/0199387 | A1 * | 10/2004 | Wang et al. | 704/243 |

OTHER PUBLICATIONS

Paul Bond, "A Star is born nationally, seeking stellar CD sales (StarCD is expanding its service nationwide that identifies music being played on the radio)". Hollywood Reporter, Wilkerson Daily Co. Hollywood CA, US. vol. 35 No. 13 Nov. 1999. p. 1. XP002939032.*

* cited by examiner

*Primary Examiner*—Barry W Taylor

(57) ABSTRACT

Calls made from mobile or cellular telephones may contain audio signals from broadcasts audible to the caller. Thus, a call made into a call center, perhaps to gain valuable information, such as traffic conditions, may be analyzed at the center to determine the source of the broadcast. This invention takes advantage of the existing communications infrastructure and provides for rapid and statistically improved estimation of listenership.

17 Claims, 2 Drawing Sheets

BROADCAST AUDIENCE SURVEILLANCE USING INTERCEPTED AUDIO

CROSS-REFERENCES TO RELATED APPLICATIONS

This application is a continuation of Provisional Application No. 60/254,740 filed Dec. 11, 2000.

BACKGROUND

1. Field of Invention

This invention relates to collecting broadcast audience listenership data by identifying the source of a broadcast signal through means of intercepting the audio portion coincidentally with a mobile telephone call and comparing the intercepted audio with a plurality of possible directly received broadcast signals.

2. Description of Prior Art

Broadcast ratings are traditionally estimated by submitting diaries to survey panelists with the request to record their radio or television (TV) listening habits. This method of statistical information gathering has limited accuracy because it relies on each sampled panelist's memory, diligence, and commitment. It also cannot provide quick or even near-instantaneous audience survey results that could be used to gauge audience interest and alter program content accordingly.

There has been considerable recent interest in the development of automatic systems and methods for measuring radio broadcast audience listenership. For example, U.S. Pat. No. 4,718,106, to Weinblatt, describes a technique that employs a survey signal added to or injected into the broadcast audio signal, which is picked up by a microphone in a portable signal detector, worn by an audience survey panelist. Any broadcast sound signals within listening range are picked up by the detector and tested to see if an injected survey signal is recognized. If one is detected, the appropriate information is time-stamped and stored in the detector memory, to be read out and reported a later time. A number of more recent disclosures, for instance U.S. Pat. Nos. 5,574,962, 5,581,800, 5,787,334, all to Fardeau, et al., U.S. Pat. No. 6,035,177, to Moses and Lu, and U.S. Pat. No. 6,151,578, to Bourcet, et al., expand this concept by encoding and embedding the survey signal(s) in such a way that they are inaudible to the listener. As with Weinblatt, these call for decoding devices installed permanently, or carried by survey panelists, nearby the actual sound signal, and for subsequent, delayed readout of data stored in decoding device memory. For an adequate survey, especially for measuring listenership of smaller radio stations, a large number of such devices must be deployed. A requirement for later readout precludes gathering timely listenership information. In order to avoid such delays, an extensive communications network must be dedicated or expensive use of existing networks, such as those for cellular calling, must be employed. U.S. Pat. No. 4,584,602, to Nakagama, describes such a TV survey system that uses injected marker signals and (near-) real-time use of the fixed telephone infrastructure.

U.S. Pat. No. 4,955,070, to Welsh and Foudraine, describes an alternative approach free of an injected survey signal. This approach also employs a portable monitor using a microphone to pick up broadcast audio sounds (an alternative calls for the use of an electromagnetic sensor to pick up emanations from currents driving a transducer, such as an earphone). However, a tuner within the monitor independently selects broadcasts of interest and a built-in processor tests the tuner output against the sounds picked up by the microphone or electromagnetic sensor in order to determine if a match occurs. Again, if a match is detected, the information is stored for later readout (at night), using a base unit. Welsh and Foudraine describe the preferred match process as "autocorrelating" the signals, but an autocorrelation process is actually incapable mathematically of producing a match. The Welsh and Foudraine approach also suffers from the difficulties of providing timely information and of requiring a large number of complex and expensive monitors for an accurate survey, just as with the systems described above.

U.S. Pat. No. 5,594,934, to Lu and Cook, disclose an audience survey "correlation meter" whereby in one embodiment portable monitoring devices with microphones pick up broadcast sound signals and compare them sequentially with "snippets" taken from broadcast signals of interest. The snippets, or "reference side representations" derived from them, are transmitted sequentially to the portable monitoring devices, where they are correlated with the broadcast sound signals. Matches found by the correlation process are stored for later recovery. This approach also suffers from the difficulties of providing timely information and of requiring a large number of complex and expensive monitors for an accurate survey. An alternative embodiment described by Lu and Cook shifts the correlation process from the portable monitors to a fixed location within a structure where survey data are desired. Pick-ups such as microphones, photodetectors, or induction coils are associated with nearby radio or TV receivers whose outputs are to be monitored. Simultaneously, a bank of individually tuned receivers comprising part of the fixed location correlation meter receives a plurality of carriers that have been mixed with a corresponding plurality of picked-up receiver outputs. Also simultaneously, the fixed correlation meter receives, via an antenna link, reference side representations (snippets) from an external source, and performs a zero-crossing correlation operation with a plurality of signals derived by stripping off the carriers. Any matches declared are downloaded to a remote point, perhaps via public telephone lines. This system relies on simultaneous and continuous transmission of numerous electromagnetic signals and is thus useable only for short-range, local installations. Both of the Lu and Cook embodiments require the broadcast of snippet information over a large area, with multiple correlation meters, in order to provide a statistically accurate survey, which requires a powerful transmitter of its own.

In U.S. Pat. No. 5,410,724, to Worthy, discloses a remote vehicular radio audience survey system that depends on detection of the local oscillator (LO) signal. LO signals are inadvertently radiated as part of the standard receiving process and are unique to each broadcast station tuned in. These radiations may be detected by roadside installations (remote survey sites) as vehicles pass by. In U.S. Pat. No. 5,749,043, also to Worthy, discloses a system primarily employing LO sensing at numerous remote survey sites, a central office, and sites to access data from the central office. Meanwhile, radio broadcasts are to be monitored in the central office, or elsewhere, to determine programming, by undisclosed means, possibly digitized and stored, or otherwise identified, so that they may be associated with LO survey results. Besides being rather unwieldy, and apparently requiring human intervention, most of these steps are unnecessary, as the LO signals, to the extent that vehicular radios follow the de-facto industry standard design, uniquely identify the broadcast source in an geographical area, because stations sharing the same frequencies are spaced far apart in order to minimize interference. A large number of survey sites need to be installed in order to adequately cover a geographical area. In U.S. Pat. No. 5,819,155, to Worthy and Dubrall, discloses a system to overcome limitations of LO sensing for the AM radio band. In this system, survey signals are to be injected on top of specified broadcast signals as vehicles pass by survey sites and, if a radio is tuned to a specified broadcast station, the resulting disturbance is sensed externally to the vehicle, specifically by sensing the weak magnetic effect produced by loudspeakers. This may produce objectionable interference to listeners and requires the expensive and intrusive installation of a large magnetic loop in the roadway.

U.S. Pat. No. 5,839,050, to Baehr and Chambers, describe a survey system wherein roadside survey sites attempt to sense the any inadvertent "intermediate frequency" (IF) emanations from vehicular radios. However, the signal described therein is actually an LO signal, and the process is similar to that described in U.S. Pat. No. 5,410,724, to Worthy, and therefore shares the same limitations. True IF emanations are even weaker that LO emanations and are therefore harder to detect. In addition, a match process such as cross-correlation with broadcast signals of interest would have to be provided in order to identify the broadcast source.

SUMMARY

In accordance with the present invention incoming telephone calls that may contain an intercepted background audio signal are electronically processed and compared using statistical techniques with various simultaneous broadcasts of interest to determine if a match occurs. This method provides a means for directly and rapidly measuring radio or TV broadcast listenership.

A customer, who may be in a vehicle, calls into the call center, and a short segment is digitally recorded and stored in an electronic database. The start time of this segment is also recorded and linked to the caller in the database. The caller has previously registered with the service, typically at a registration website, in order to gain access to an important service, such as special traffic reports. The registration process required the customer to provide valuable demographic information concerning his/herself, which is also recorded in the database and related to this specific call segment. Multiple call segments, from both multiple callers and possibly the same caller at different times, are stored in the database. In the preferred implementation, the incoming call would be pair-wise cross-correlated for a substantial portion of its duration with all of the broadcasts of interest. Alternatively, all or part of the incoming call could be recorded digitally along with the broadcast segments for later processing. Since the radio in a vehicle is typically audible to the driver and to each and every passenger, in most cases the mobile phone is likely to pick up a significant audio signal emanating from the radio speakers. Even a weak or virtually inaudible pick up, such as would happen if the radio volume is turned down, but not completely off, may be usable after suitable signal processing. If a particular pair-wise cross-correlation value exceeds a threshold, which depends on the desired detection probability-of-detection and false-alarm rates, as well as the signal-to-noise ratios of the pair-wise compared signals, a match is declared. Then a database of such match reports is updated that would permit generation of relevant statistical reports. The database may be accessed for such reports in real-time, or at intervals of interest to report subscribers.

OBJECTS AND ADVANTAGES

Accordingly, an object and advantage of this invention is to provide an economical means to acquire broadcast listenership data.

Another objective and advantage of this invention is to increase the sample size in order to improve the accuracy of broadcast listenership estimates.

Another objective and advantage of this invention is to reduce bias and errors in broadcast listenership statistical estimates by directly and unobtrusively measuring the listeners' habits.

A further objective and advantage of this invention is to eliminate a need for a plurality of remote survey sites dependent on receiving weak incidental emanations from vehicular broadcast receivers.

Another objective and advantage of this invention is to acquire broadcast listenership information for broadcasts that do not employ injected or embedded survey signals.

Another objective and advantage of this invention is to obtain instantaneous listenership data.

Yet another objective and advantage of this invention is to afford changing broadcast content rapidly in response to listener interest.

Further objects and advantages will become apparent from a consideration of the drawings and ensuing description.

DRAWING FIGURES

REFERENCE NUMERALS IN DRAWINGS

Figure 1:
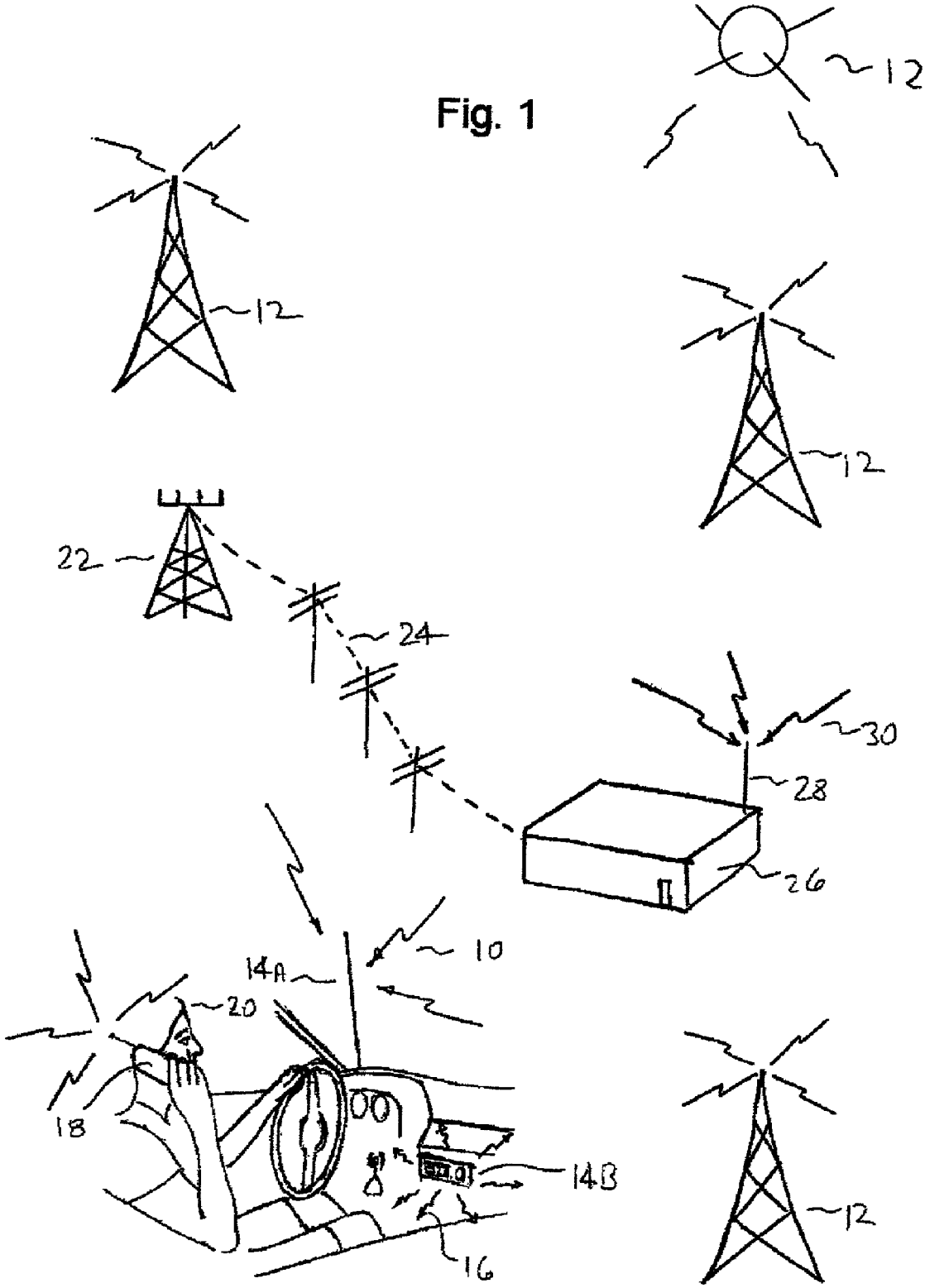
FIG. 1 is an overall perspective view illustrating the principal elements of our invention.

10 broadcast signals
12 broadcast transmitters
14A antenna
14B vehicular receiver
16 broadcast sounds
18 communications device
20 mobile user
22 cellular receiving sites
24 land lines
26 processing center
28 common antenna
30 broadcast signals of interest
32 calls
34 call center
36 request processor
38 database manager
40 input/output interface
42 receiving antenna
44 distribution network
46 receiver bank
48 match processor
50 statistical data

DESCRIPTION

Preferred Embodiment

FIG. 1 shows the main elements of the preferred embodiment of the present invention and their relationships. One of many possible broadcast signals 10 from numerous broadcast transmitters 12 is received by a vehicular radio consisting of antenna 14A and vehicular receiver 14B tuned to a particular broadcast station. A representation of broadcast sounds 16 produced by the vehicular radio may be picked up or intercepted by a portable communications device 18, such as a mobile or cellular telephone, that is in use. These sounds may contain encoded, injected, or embedded survey signals as well as the regular program material. The communications device is in use by mobile user 20, who would typically be a vehicular passenger or driver. Some part of the electrical signals produced by the intercepted broadcast sounds 16 are then transmitted by the communications device 18 along with the normal conversation and other background sounds and noises. Signals from communications device 18 are received at one or more cellular or similar receiving sites 22. Mobile user 20 using communications device 18 is connected to processing center 26 via receiving sites 22 and land lines 24. Thus the intercepted representative broadcast sounds are sent as electrical signals from portable communications device 18 along land lines 24 to the processing center 26. Alternatively, the intercepted broadcast sounds may be transmitted to processing center 26 as radio signals or by a combination of links comprising established telephone infrastructure elements. Simultaneously, all broadcast signals of interest 30 are received at processing center 26, either using a common antenna 28 or a multiplicity of such antennae. These antennae 28 need not be collocated with the processing center. Other means for collecting or receiving broadcast signals, such as cable, direct satellite, etc., may be employed.

Figure 2:
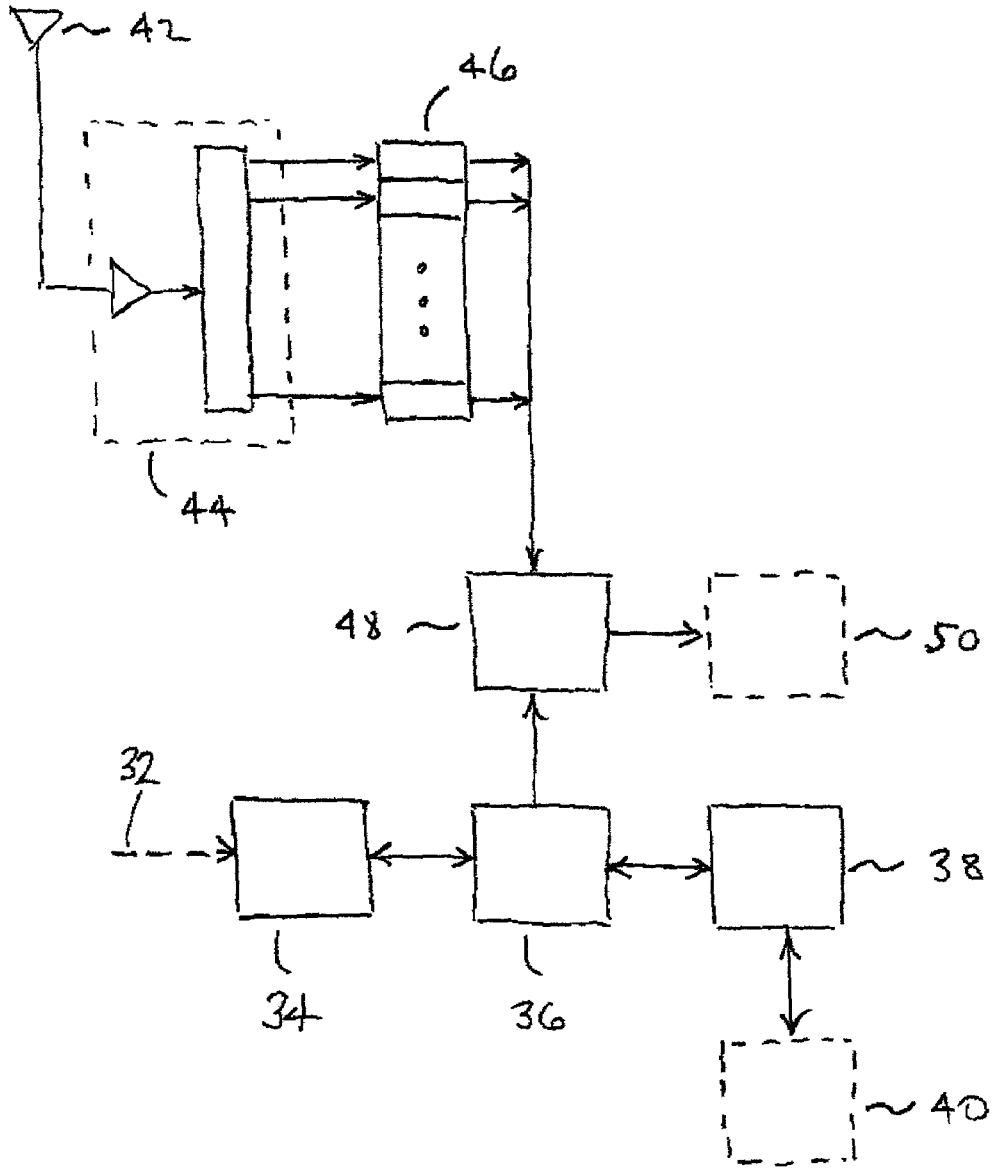
FIG. 2 is a block diagram showing the principal elements of a processing center.

FIG. 2 is a block diagram showing the principal elements of processing center 26. For clarity, processing center 26 is depicted as a single entity at one location. However, the elements comprising processing center 26 may be dispersed geographically. In addition, the elements comprising center 26 may be combined or contained within the same physical units. Calls 32 from mobile users 20 are routed into a call center 34. Call center 34 may be a plurality of computer processors that may not necessarily be co-located with each other. A plurality of geographically dispersed call centers 34 may alternatively be employed for each processing center 26. Some of the incoming calls contain intercepted broadcast sounds or other content of interest or utility. Audio signals from incoming calls 32 are electronically digitized in the call center 34. Call center 34 also tags initial user requests with identifiers and a time stamp and communicates with request processor 36, which again may be a plurality of computer processors. Request processor 36 generates queries and responses for the mobile users 20 and communicates with a database manager 38. Database manager 38 contains databases regarding the users and information desired by or important to the users and is attached to an input/output interface 40. Request processor 36 also processes the incoming-call audio signals 32 digitized in the call center 34, which originate from many communications devices 18. Some of these digitized incoming-call audio signals 32 may contain representations of the broadcast signals of interest 30. These received and digitized incoming-call audio signals 32 are communicated to a match processor 48. Alternatively, digitized incoming-call audio signals 32 can be communicated directly to match processor 48.

Simultaneously, broadcast signals of interest 30 are received by the processing center using groupings comprising receiving antenna 42, distribution network 44, and receiver bank 46. Several groupings of antenna 42, network 44, and receiver bank 46 may be necessary to accommodate all signals of interest 30. For example, different embodiments will be necessary to accommodate AM and FM broadcasts. Additional groupings of antenna 42, network 44, and receiver bank 46 may be needed to cover a wider geographical area. The outputs of receiver bank 46 are digitized, processed, and fed to the match processor 48. Match processor 48 may employ electronic storage means in order to record or store both the digitized incoming-call audio signals and the plurality of digitized and processed outputs from receiver bank 46. The output of the match processor consists of statistical data 50.

DESCRIPTION

Additional Embodiments

In an alternative embodiment, antenna 42, network 44, receiver bank 46, and match processor 48 may be replaced by a decoder or plurality of decoders (not shown) that are capable of extracting embedded or injected survey signals.

In another alternative embodiment, calls from mobile or cellular telephones from non-vehicular locations may be tested to determine if broadcast signals are present and to identify the origins of such signals.

Operation

Referring to FIG. 1, mobile user 20 places a call to a call center 34, perhaps to obtain valuable information, such as personalized current traffic conditions, or for other reasons. This call may be routed through cellular receiving station 22 and land lines 24. If user 20 happens to be listening to a radio station at the same time, some part, or representation, of broadcast sounds 16 will be picked up by communications device 18. Even a weak or incomplete representation of broadcast sounds 16 will be transmitted by communications device 18. Weak or incomplete pickup of sounds 16 may occur if user 20 is using a "hands-free" communications device 18, sound cancellation or sound-activated transmission are employed by device 18, the vehicular radio is turned down, or other backgrounds noises are strong. Concurrently, a plurality of broadcast signals of interest 30 are received at processing center 26. Broadcast signals of interest 30 may be all those whose listenership statistics are desired.

Referring to FIG. 2, calls 32 are answered by call center 34, which electronically digitizes the audio portions of the incoming calls. If the call originated from a user 20 who simultaneously has his or her vehicular radio 14A and 14B on, a digitized incoming audio call may contain a representation of one of the broadcast signals of interest. The digitized incoming audio calls are passed to match processor 48. At the same time, digitized outputs from receiver bank 46 are also passed to match processor 48. Individual receivers comprising bank 46 are tuned individually to each of the broadcast signals of interest. In match processor 48, the representation of the intercepted broadcast sounds or other content of interest or utility digitized in the call center 34 are electronically compared to the digitized outputs of receiver bank 46 using various mathematical and statistical techniques apparent to those skilled in the art, such as cross-correlation and covariance analysis techniques. Cross-correlation is a particularly powerful and useful technique for identifying pairs of signals with common elements. To accommodate possible time shifts between the incoming audio calls and the broadcast signals, cross-correlation is preferably accomplished over a range of time offsets, or lags. Co-spectral or coherence analysis, which is the frequency domain analogue of cross-correlation, may be usefully employed as well. Statistical decision techniques, such as a maximum-likelyhood criteria, may be applied to decide if a match may be declared. If a match is declared, the broadcast transmitter or source is identified. Alternatively, the digitized incoming audio calls may be processed by themselves in order to extract or recover any embedded or injected survey signals. Preferably, this processing may be done essentially concurrently with reception of calls 32 ("near real time"). Alternatively, the digitized incoming calls 32 and receiver bank 46 outputs may be recorded for later processing. Post processing may be necessary in order to handle peak call-in periods, such as during commute times. An optimum combination of near-real-time and post processing is the preferred method. Alternatively, both the incoming calls 32 and receiver bank 46 outputs may be partially processed in near real time and the partially processed data stored for later completion. Partial processing may achieve a useful degree of data compression.

Conclusions, Ramifications, and Scope

Accordingly, the reader can see that we have provided a method of estimating the number of listeners and potential listeners exposed to particular or specific radio and television broadcasts by comparing intercepted audio portions of the broadcasts with a set of possible broadcasts in order to identify the source of the broadcast. Alternatively, the intercepted audio may contain embedded or injected survey signals, which may also be decoded to identify the broadcast source. One application of this invention addresses measuring automobile and other vehicular radio listenership. In vehicular applications, providing a useful service, such as providing customized, detailed, and up-to-the-moment traffic and congestion information, could be used to induce drivers and passengers to frequently place calls into a call center The audio is intercepted as background sounds picked up during telephone calls into a call center. An advantage provided by this method over previous methods is a significant and low-cost expansion of the sample size, which enhances the accuracy of listenership statistics, such as the audience size. An additional advantage provided is the ability to collect and disseminate listenership information and statistics in near real time. This provides a means for changing programming in response to audience interest.

Although the description above contains many specificities, these should not be construed as limiting the scope of the invention but as merely providing illustrations of some of the presently preferred embodiments of this invention. Various other embodiments and ramifications are possible within it's scope. For example, calls into a call center may contain intercepted audio signals that may be processed or compared to other signals for other purposes.

Thus the scope of the invention should be determined by the appended claims and their legal equivalents, rather than by the examples given.

We claim:

1. A broadcast-signal source identification method, comprising, in combination, (a) receiving calls from one or more telephones;

(b) digitizing all or part of the audio-frequency content of said received telephone calls;

(c) receiving broadcast signals from one or more known sources at substantially the same time as the received telephone calls;

(d) digitizing all or part of the audio-frequency content of said received broadcast signals;

(e) comparing the digitized contents of the received telephone calls to the digitized contents of the received broadcast signals to determine the degree of match between the received telephone calls and the received broadcast signals;

(f) sensing the presence of broadcast signals in said received telephone calls based on said degree of match;

(g) recognizing the source of matching broadcast signals based on the identities of the known broadcast sources.

2. The broadcast-signal identification method of claim 1 wherein at least one of the telephones is a mobile telephone.

3. The broadcast-signal identification method of claim 1 wherein a received broadcast signal is a radio broadcast.

4. The broadcast-signal identification method of claim 1 wherein a received broadcast signal is the audio portion of a television broadcast.

5. The broadcast-signal identification method of claim 1 wherein a received broadcast signal is a broadcast from a satellite.

6. The broadcast-signal identification method of claim 1 wherein the method for comparing said content of said received telephone calls to said content of said received broadcast signals is a statistical signal analysis method.

7. The statistical matching means of claim 6 wherein said signal analysis method is cross-correlation analysis.

8. The cross-correlation analysis of claim 7 wherein said cross-correlation analysis is performed at positive and negative relative time lags.

9. The statistical matching method of claim 6 wherein said signal analysis method is co-spectral analysis.

10. The broadcast-signal identification method of claim 1 wherein the content of the received broadcast signal contains an incidental encoded, injected or embedded survey signal.

11. The broadcast-signal identification method of claim 1 further including associating data related to the identity of a calling telephone.

12. An apparatus for identifying the source of a broadcast signal, comprising in combination, (a) means for receiving one or more incoming telephone calls;

(b) means for digitizing all or part of the audio-frequency contents of said incoming telephone calls;

(c) receivers for one or more broadcast signals;

(d) means for digitizing substantially at the same time as said received telephone calls all or part of the audio-frequency output signals from said broadcast receivers;

(e) processing means for matching said digitized audio contents of one or more said incoming telephone calls with one or more said digitized audio-frequency output signals of said broadcast receivers;

(f) automated decision means for identifying the source of broadcast signal is based on the degree of said matching.

13. The apparatus of claim 12 further including automated means for reporting said identification decisions on the sources of broadcast signals.

14. The apparatus of claim 13 further including automated means for generating a listenership report.

15. The broadcast-signal source identification apparatus of claim 12 wherein the broadcast source selection decisions are associated with demographic information related to the identities of callers making the incoming telephone calls.

16. The broadcast-signal source identification apparatus of claim 15 wherein a demographics database is generated by inducing callers to provide demographic information in return for a service.

17. The broadcast-signal source identification apparatus of claim 16 wherein said service is traffic information.

* * * * *